United States Patent [19]

Witt et al.

[11] Patent Number: 4,467,697

[45] Date of Patent: Aug. 28, 1984

[54] ANTI-RECOIL ARRANGEMENT

[76] Inventors: Leonard Witt; Mary L. Witt, both of 1923 N. Howe St., 2R, Chicago, Ill. 60614

[21] Appl. No.: 365,380

[22] Filed: Apr. 5, 1982

Related U.S. Application Data

[63] Continuation-in-part of Ser. No. 065,113, Aug. 9, 1979, abandoned.

[51] Int. Cl.[3] ..... F41F 19/00

[52] U.S. Cl. ..... 89/37 GM; 89/40 E; 89/191 R; 89/14 C

[58] Field of Search ..... 42/1 V, 76 R; 89/1.7, 89/1.704, 1.705, 14 R, 14 C, 37 GM, 40 E, 42 R, 167, 186, 191 R

[56] References Cited

U.S. PATENT DOCUMENTS 1,196,197 8/1916 Witherow ..... 89/40 E
1,722,190 7/1929 Bergmann et al. ..... 89/40 E
2,679,192 5/1954 Seeley et al. ..... 89/42 R
3,491,650 1/1970 Rohr ..... 89/42 R

*Primary Examiner*—Stephen C. Bentley

[57] ABSTRACT

A fire-arm having a stable or slidable barrel, receiver, bolt and stock is provided with coaxial to the barrel slidable mass and recoil springs. During discharge the entire impulse of the recoil-force is transferred to the arrangement of slidable mass which recoils towards the gunner and thereafter the recoiling mass imparts the recoil-momentum to the fire-arm or moves against the thrust of recoil-springs to the stop point. The entire kinetic energy of the arrangement of the slidable mass is balanced by the mechanical work of the thrust of the recoil-springs. This slidable mass and the recoil springs are chosen according to the designed gear ratio and the magnitude of kinetic energy of the slidable mass. Thus the equilibrium between the thrust forces of the springs and the resistance of the gunner or tripod, are reached much easier.

1 Claim, 13 Drawing Figures

Section A-A-B-B

Section A-A

ANTI-RECOIL ARRANGEMENT

Continuation-in-part of Ser. No. 065,113, filed Aug. 9, 1979, now abandoned.

BRIEF SUMMARY OF THE INVENTION

The goal of this invention is to improve the stability of a fire-arm during discharge and easy its operation by softening the recoil. It can be adapted for target rifles, long range rifles, sniper fire-arms, for very big-bore models and small hand fire-arms.

The recoil momentum of a fire-arm can be diminished by use of muzzle-brake, however, since this has a limited use, the described invention is more practical for this adaptation.

This invention describes the changes of the corrections made in small fire-arms in this manner, so as to utilize the device of recoil gear. To this purpose, the fire-arm is equipped with an arrangement of movable mass (parallel to the barrel axis), which takes upon itself the entire force-impulse of the recoil and causes the barrel to remain jumpfree during the period of discharge. When the impuls of recoil is given to the slidable mass by use of two pistons, corresponding with two cylinders attached symmetrically and parallely to the barrel axis near the rest position of the bullet, the barrel also remains motionfree during the discharge, because this slidable mass absorbs totally the recoil momentum. After the bullet leaves the muzzle of the rifle, this slidable mass strikes the bumpers of the rifle, and both, the mass and rifle recoil together in regular manner with velocity corresponding to their masses. But when this mass, after absorbing the whole recoil-momentum, moves parallel to the barrel axis against the thrust of recoil springs and with the moment, it stops, when kinetic energy reaches the value of 0—on the shooter, or tripod, only the thrust of the recoil springs is exerted. The transferred energy on the shooter, or tripod, is equal 0, but only when the two forces: that of the resistance of the shooter, or of the tripod, and that of the recoil springs are in a state of equilibrium. These push-forces of the recoil springs acting on the shooter, or tripod, are much smaller than that of the discharge, but act in proportionately longer time: the whole recoil momentum remains unchanged. The recoiling mass after stopping returns to its rest position but braked by air pressure in pneumatic cylinder and its momentum never reaches the magnitude of the primary recoil momentum.

The excessive weight of big caliber rifles, and disadvantage of use of a very high pressurized gasses, is avoided in the adapting of the barrel long-recoil device, however, the accuracy of the rifle becomes slightly less. According to this device, the barrel rests in its discharge position. The additional mass is held in the rear position and released by discharge which causes firing of the cartridge and after the bullet leaves the muzzle, strikes the recoiling barrel. After both parts connect, both recoil to the rear to the moment, the kinetic energy reaches the value of 0. Thus the additional mass after disconnecting from the barrel is held in the rear position, the barrel returns to its rest position, braked by the air pressure in the air-cylinder. In this position the barrel can be reloaded.

All these devices can be used for the specified momentum of each rifle, regardless of the magnitude of the weight of bullet, or value of velocity, if only the product: mass of bullet times velocity remains the same.

BRIEF DESCRIPTION OF THE DRAWINGS

All changes in construction of fire-arms are explained in the following drawings.

DETAILED DESCRIPTION OF THE INVENTION

Figure 1:
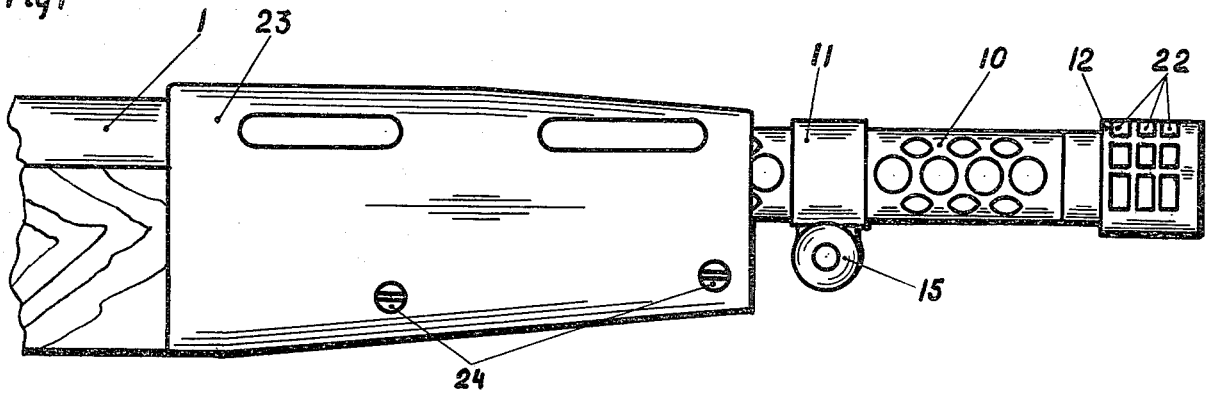
FIG. 1 is a view of a rifle.

FIG. 1 shows a rifle with a receiver 1 equipped with an anti-recoil arrangement which is covered by a hand-grip 23 and fastened to the rifle by a pair of screws 24; a housing 10 with a bushing 11 and an ear 15, and a muzzle-brake 12 with several vanes 22. The brake 12 is screwed on the housing 10.

Figure 2:
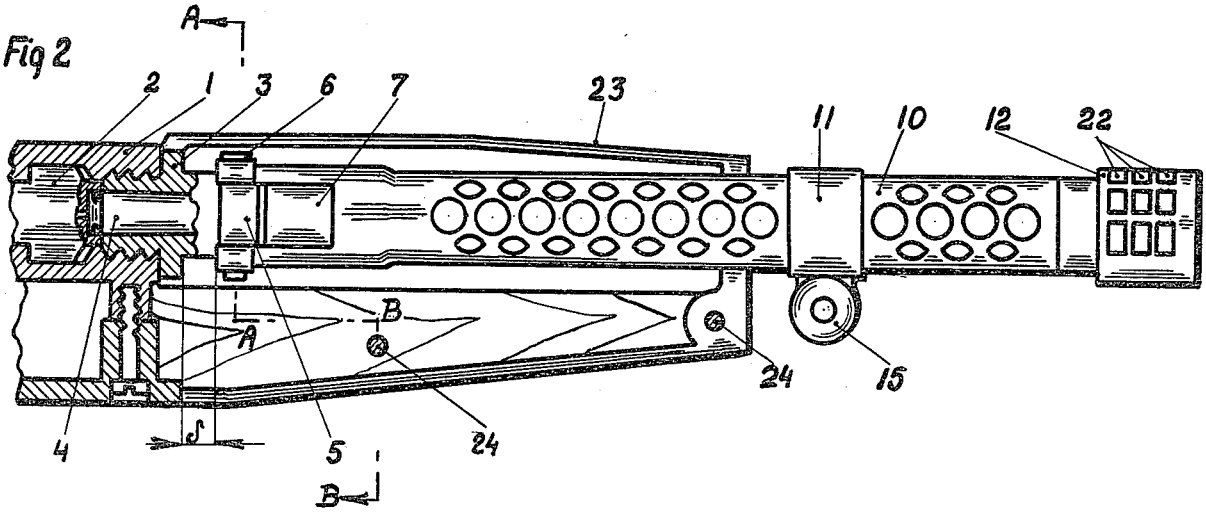
FIG. 2 shows the rifle from FIG. 1 with removed hand-grip, and partial section of the cartridge chamber.

FIG. 2 shows the rifle from FIG. 1 with a bolt 2, a barrel 3 and a cartridge chamber 4. On the barrel 3 are placed symmetrically, on both sides and parallel to the axis of the barrel 3—two cylinders 7 with two pistons 5. Each piston 5 is connected with the housing 10 by a pin 6.

Figure 3:
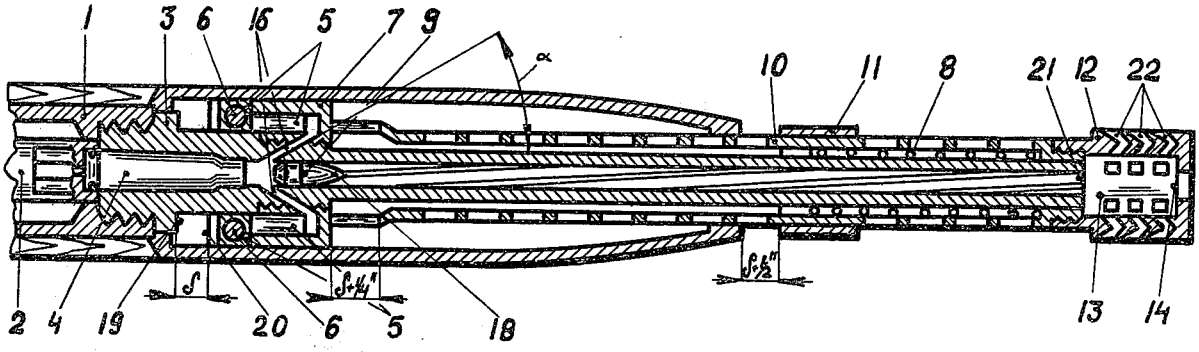
FIG. 3 is coaxial section of the rifle from FIG. 1 showing the high pressure cylinder.

FIG. 3 shows a cross-section of the rifle from FIG. 1 and shows the cylinders 7, each connected by a hole 16 under angle alpha to the inside of the barrel 3 near the rest position of a bullet 18 in the front of its edge 9. The housing 10 is pressed by a spring 8 in its resting position, so as between edges 19 and 20, limiting the backmovement of the housing 10, arises a distance delta, and between the housing 10 and the bushing 11—a distance delta plus ½". The brake 12 at a muzzle 21 of the barrel 3 has a chamber 13 with a hole 14 for passing of the bullet 18.

Figure 4:
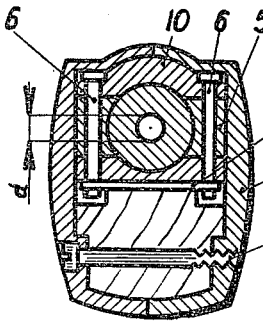
FIG. 4 is cross-section A—A—B—B of the rifle from FIG. 1.

FIG. 4 is a cross-section A—A—B—B of the rifle from FIG. 1 and shows the fastening of the housing 10 with the pins 6 and a safety spring 17, and fastening of the grip 23 by the screws 24.

By discharge the housing 10 is pushed by the pistons 5 to the rear and because the area of both pistons 5 is the same as that of the barrel 3, powder gasses under high pressure impart to the housing 10 a momentum which is equal in magnitude to the recoil momentum and causes the barrel 3 to stay in equilibrium without any movement. After the bullet 18 leaves the muzzle 21, the brake 12 starts to work, because the powder gasses flow through the nozzles 22 and diminish the recoil momentum. After designed time the edge 20 bumps the edge 19 and transferres the remaining recoil momentum to the body of the rifle.

The rifle by means of the ear 15 can be connected to a rigid tripod having sufficient resistance potential ability to the recoil momentum of the rifle. The edges 19 and 20 don't meet, the tripod compensates the whole momentum.

Figure 5:
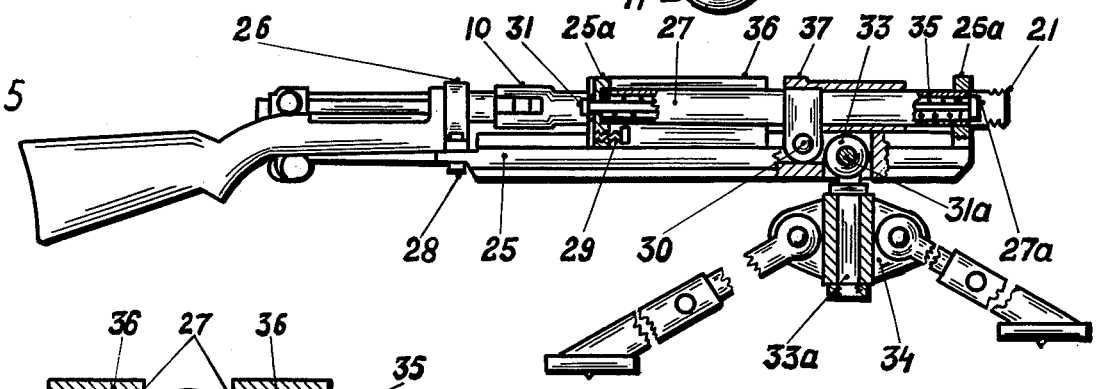
FIG. 5 shows the rifle from FIG. 1 on a tripod with the right cylinder removed.
Figure 7:
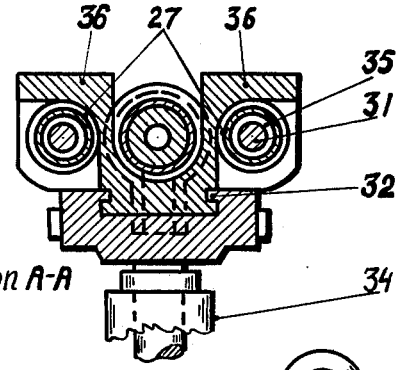
FIG. 7 shows cross-section of the rifle from FIG. 1.

FIG. 5. The grip 23, the screws 24—FIG. 4, and the muzzle brake 12—FIG. 3, are removed from the rifle from FIG. 1. On the housing 10 is slipped a sleeve 37 from the muzzle 21, and connected to the housing 10 by means of a pin 30. Thereafter the rifle is placed in a slider 24 in such way, that guiding slots 32—FIG. 7, of the sleeve 37, find the corresponding openings in the guiding slots 32 of the slider 25. The rifle can be pushed forward and a holder 26 closed by means of screws 28. The ear 15—FIG. 1, in resting position touches an ear 33 of a tripod 34. The slider 25 has two consoles 25*a* to place two cylinders 27 with recoil springs 35 and pins 31 acting on a sliding mass 36: FIGS. 5 and 7. The edges of the sliding mass 36 and that of the sleeve 37 are separated and the distance between the edges can be adjusted by screws 29.

Figure 6:
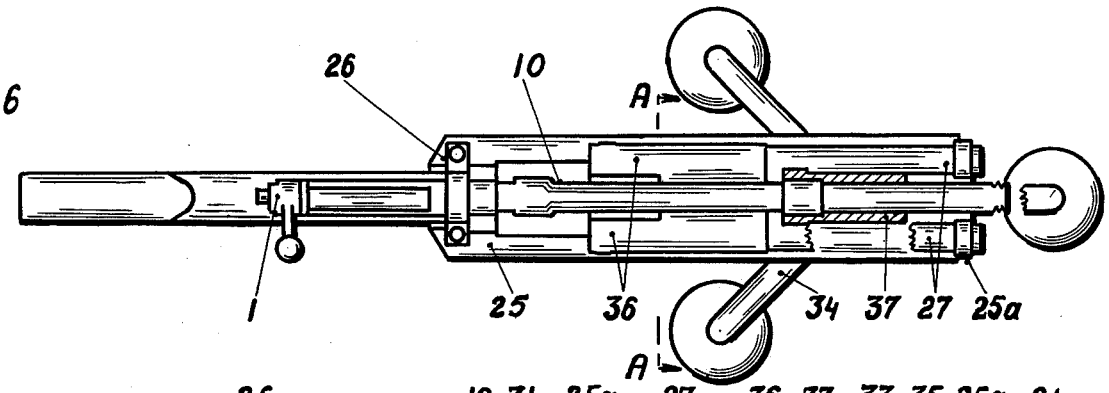
FIG. 6 is a view of the rifle from FIG. 1 on the tripod.

FIGS. 5, 6 and 7. By discharge the housing 10 with the sleeve 37 intercept the whole momentum and recoil to the rear. Before the bullet 18—FIG. 3, leaves the muzzle 21, the housing 10—FIG. 6, and the sleeve 37 impact against the sliding mass 36. By the screws 29 can be found such position for the sliding mass 36, that after the impact, the housing 10 with the sleeve 37 remain almost motionless and the recoil momentum will be transferred to the mass 36 which itself recoils to the rear to the moment its kinetic energy reaches the value of 0, compressing the recoil springs 35. Thereafter the mass 36 returns to its rest position braked by an air pressure in the cylinders 27. This pressure can be regulated by turning of end plates 27*a*. Since the whole kinetic energy of the sliding mass 36 is balanced by the mechanical work of the thrust of the springs 35 on the length of the recoil path, only the thrust of the springs 35 acts on a pin 31*a* and the tripod 34. The weight of the sliding mass 36 and the thrust of the springs 35 are chosen according to the recoil gear ratio to compensate totally the kinetic energy of the mass 36 by mechanical work of the springs 35 and to make this thrust comfortable to the shooter and adaptable by the tripod 34. The force of the thrust of the springs 35 is much smaller that that of the recoil but acts in corresponding extended time interval, because the magnitude of the recoil momentum can not be changed in this manner. The rifle remains motionless during the discharge. Center of gravity of the mass 36, and the axis of the barrel 3—FIG. 2, are placed on the same plane. Since the center line of the pin 31*a* is placed below that plane—it causes to appear a small bending moment on the rifle by each discharge.

The rifle can be moved during aiming: in horizontal plane around a pin 33*a* of the tripod 34, and around the pin 31*a* in vertical plane.

After shooting, the rifle can be quickly disassembled in reverse order to the assembly, or by removal of the pin 33*a* from the tripod 34.

Figure 8:
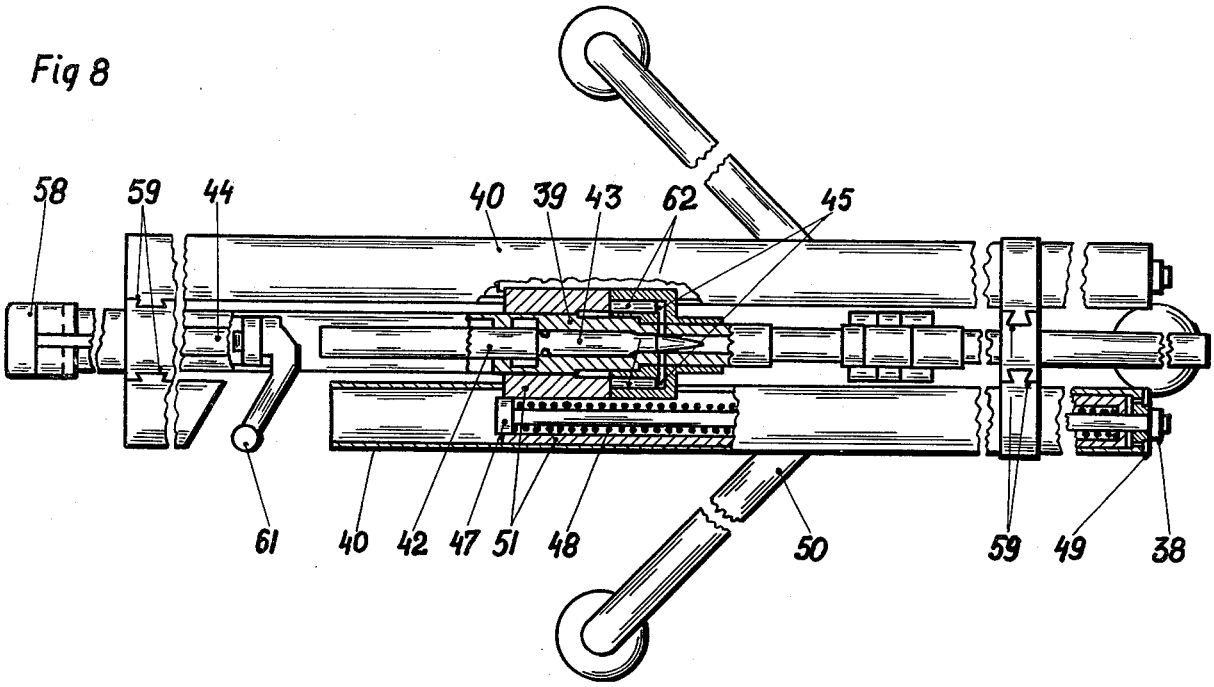
FIG. 8 is a view of a big-caliber rifle for firing with use of a tripod.
Figure 9:
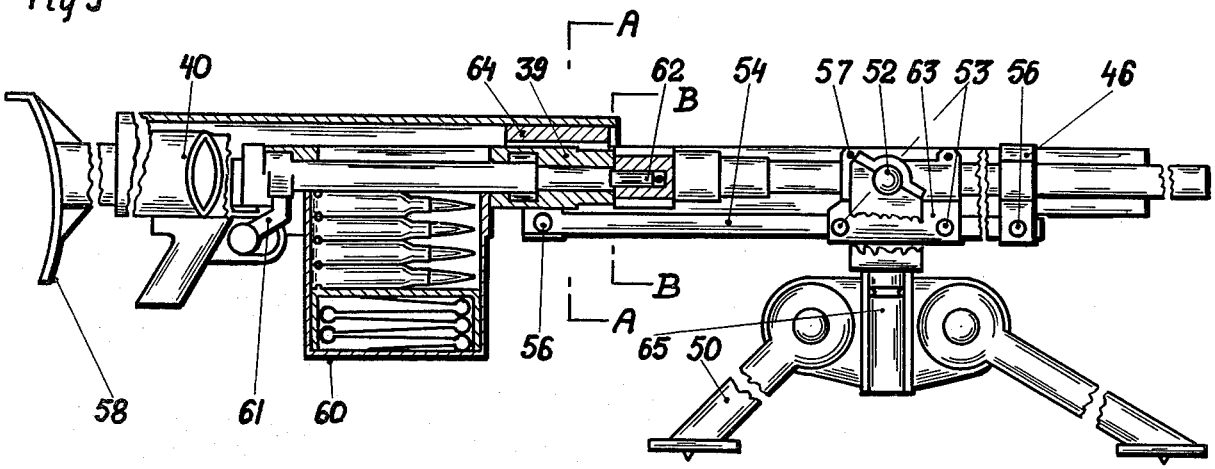
FIG. 9 shows the rifle from FIG. 8 mounted on the tripod, side view with front cylinder removed.
Figure 10:
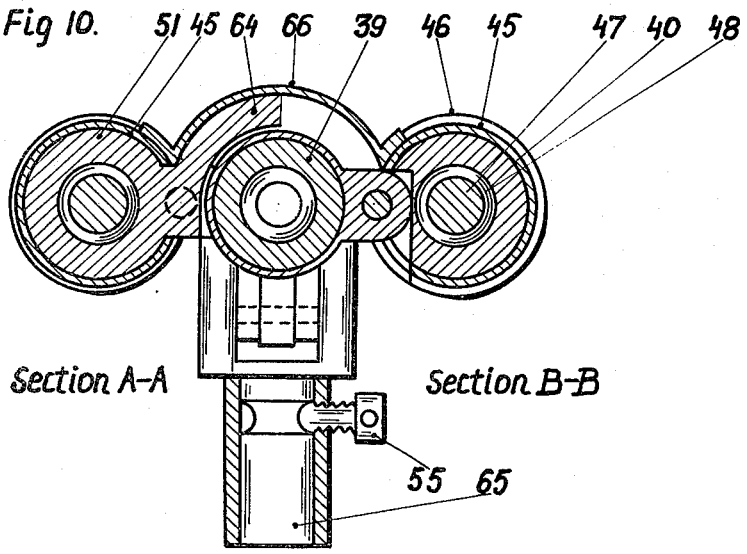
FIG. 10 shows cross-section of the rifle from FIG. 8.

FIGS. 8, 9 and 10 show a rifle adapted to .50 cal. Ball M 2 ammunition, but for use on a tripod 50.

FIG. 8 is a top view of the rifle on the tripod 50. The rifle has a receiver 44 with a butt 58, a bolt 42 with a bent handle 61, a barrel 39 with a chamber 43 and two symmetrically and parallelly to the axis of the barrel 39, placed cylinders 45 with pistons 62, and two cylinders 40 with fixing consoles 59 for quick disassembly. Powder gasses by discharge flow under high pressure into the cylinders 45 pushing the pistons 62 and a mass 51 and imparting to the mass 51 the whole recoil momentum. The mass 51 is placed slidably in the cylinders 40. Thus the barrel 39 remains motionless during discharge. The mass 51 connected with a bridge 64—FIG. 9, recoils against the thrust of springs 48 cooperating with the mass 51 by means of pins 47 fastened by nuts 38; plus vacuum force which is created in the cylinders 40 during recoiling. The mass 51 recoils to the point its kinetic energy becomes equal 0, therefore it stops and returns to its rest position braked by air pressure in the cylinders 40. This vacuum by recoiling of the mass 51 as well the air pressure by returning of the mass 51, can be adjusted in the cylinders 40 by turning end plates 49. In this manner a gunner can counteract to any differences in the magnitude of the recoil momentum caused by different loads of cartridges and temperature changes. The recoiling mass 51 never reaches bumpers at the end of the cylinders 40 (not shown on the drawings). Thus only the thrust of the recoil springs 48 plus vacuum force created in the cylinders 40 effect the tripod 50.

FIG. 9 shows that the right cylinder 40—FIG. 8, has a slot to allow reloading of the rifle by the bent handle 61, taking cartridges from a magazine 60. A guiding bar 54 is attached the the barrel 39 by means of a console 46 and screws 56. An adjustable head 63 of the tripod 50 has a shaft 52 and screws 53 and 57 to fasten the head 63 in its resting position. The tripod 50 allow to move the rifle by aiming: around the shaft 52 in vertical plane, and around a pin 65 in horizontal plane.

FIG. 10 is section A—A—B—B of the rifle from FIG. 8, and shows that the mass 51 being connected by the bridge 64 and covered by a shield 66, can be quickly removed from the tripod 50—upwards together with the cylinders 45, because the connection is made by two consoles 59—FIG. No. 8. The tripod 50 can be quickly disassembled by loosening of a screw 55, which fixes the pin 65 of the head 63—FIG. 9.

Figure 13:
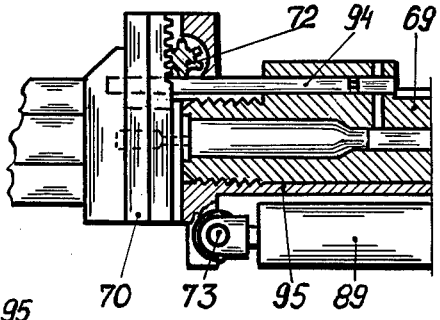
FIG. 13 shows the safety arrangement of the rifle from FIG. 11.
Figure 11:
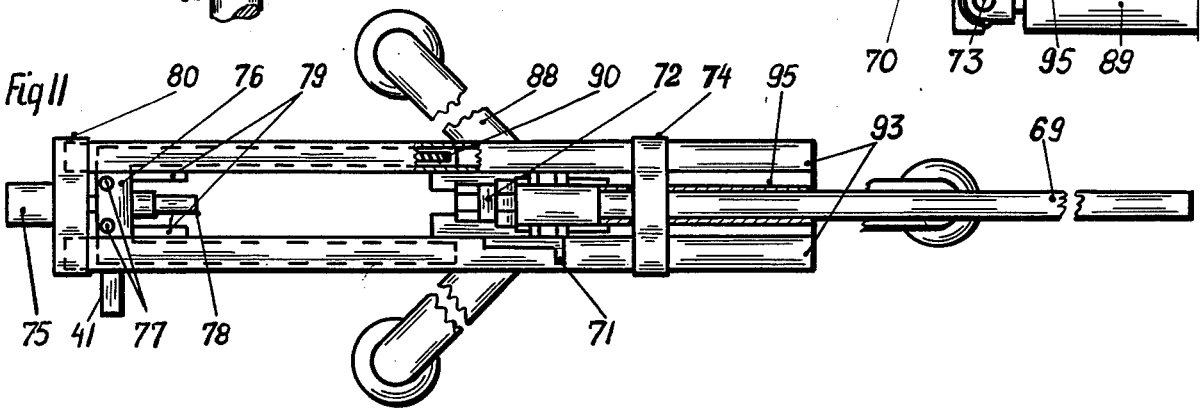
FIG. 11 shows a view of a very big bore rifle mounted on a tripod.
Figure 12:
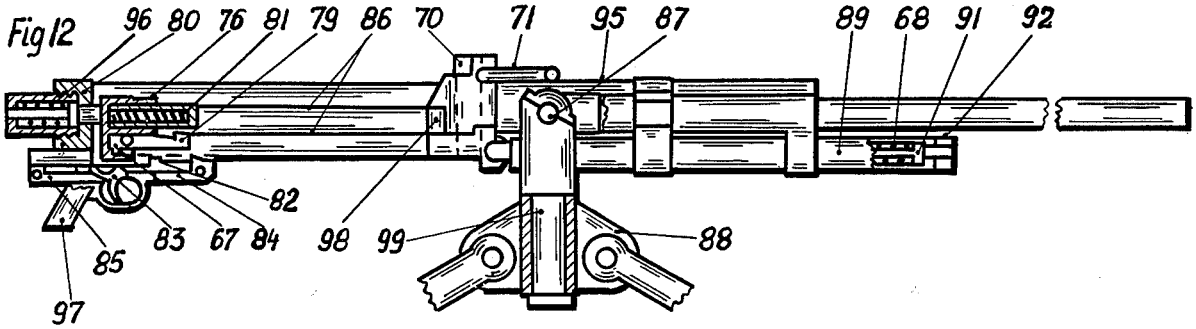
FIG. 12 is a side view of the rifle from FIG. 11, right cylinder removed.

FIGS. 11, 12 and 13 present a big bore rifle with a barrel 69 for use with a tripod 88. The single shot rifle with the barrel 69 having a sliding wedge block 70 actuated by a handle 71 and a rack rail shaft 72, is resting in firing position in a sleeve 95. A pressure and vacuum air cylinder 89 with a piston 91 and a spring 68, are attached to the barrel 69 by means of a pin 73. An end plate 92 serves to adjust the vacuum by recoiling, and air pressure by returning of the barrel 69 to its rest position. The rifle is movable on the tripod 88—around a shaft 87 in vertical plane, and around a pin 99 in horizontal plane. By shooting a transverse 76 will be moved back by means of a handle 41 to the moment a sear 84 stops it. By use of a grip 97 and a trigger 83, which lowers a bar 85 and causes to lower the sear 84, will be released the traverse 76 which under thrust of springs 90 moves forward. A hammer 78 hits a striker in the block 70 causes discharge. The hammer 78 reaches the edge of the block 70 and stops compressing a spring 81; the barrel 69 recoils. After a bullet leaves a muzzle of the barrel 69, the traverse 76 hits the barrel 69. Two hooks 79 being pushed by a pair of springs 77 connect both parts and this arrangement recoils towards a gunner against the thrust of the springs 90 and 68 plus force of vacuum in the cylinder 89 adjustable by the plate 92. The traverse 76 connected with the barrel 69 stops before hitting a bumper 75 with a spring 96. By the recoiling movement of the traverse 76, the hooks 79 will be disconnected, because their protrusions 67 hit the guiding body of the grip 97. By each discharge, the traverse 76 actuates a safety plug 94 placed in the barrel 69 when it hits the sliding wedge block 70, after the gaseous pressure in the barrel 69 dropped, and connects the inside of the barrel 69 with the atmosphere. When a delayed discharge occurs it will be significantly weakened. The recoiling traverse 76 actuates a disconnector 82. The traverse 76 stops in the rear position held by the sear 84. The barrel 69 returns to its rest position under the thrust of the spring 68 braked by air pressure in the cylinder 89. The rifle can be reloaded by use of the handle 71 to open the sliding wedge block 70. The traverse 76 and protrusions 98 of the barrel 69 move in a pair of guiding grooves 86 of cylinders 93 fastened with the rifle by a console 80 and a console 74. During discharge and during recoiling of the barrel 69 with the traverse 76, only the thrust forces of the springs 90 and 68 plus adjustable force of vacuum in the cylinder 89 act on the tripod 88.

COMBAT GUNS

Combat guns can be built according to the model with movable barrel to obtain the lightest weight: FIGS. 11 and 12. It would have some interest for distroying armored targets because claimed anti-armour ammunition for big caliber machine guns and for small cannons penetrates heavy armours. Moreover, such rifle is universal one against all targets. However, combat rifles which would shoot by each angle of elevation to the horizontal plane should have pneumatic balancing of the vertical component forces of the weights of all heavy movable masses.

I claim:

1. A firearm comprising:

a wooden stock, a receiver mounted in said stock, a bolt mounted in said receiver for longitudinal movement, a barrel mounted on said receiver to extend forwardly thereof, said barrel having a rear end, a muzzle end and an axis extending from said rear end to said muzzle end along the direction of movement of said bolt, said barrel having a chamber at its rear end near where it is mounted on said receiver, said chamber being coaxial with said barrel axis, said barrel having a bore extending from said chamber coaxially with said barrel axis to said muzzle end, an unfired cartridge with a bullet attached thereto, said unfired cartridge being in said chamber and said bullet attached thereto being in said bore defining the rest position of said bullet, two cylinders placed on said barrel near said rest position of said bullet, said two cylinders each having an axis parallel to said barrel axis, passages connecting said bore of said barrel to said cylinders to conduct gas generated upon discharge of said unfired cartridge to each of said two cylinders, a movable housing having rearward and forward ends and mounted coaxially with said barrel and slidable along said barrel, two pistons, means attaching said two pistons to said housing near the rearward end thereof to be coaxial with said two cylinders, a first spring biasing said housing such that said two pistons are biased toward said rest position, whereby, discharge of said unfired cartridge produces gas which propels said bullet through said bore beyond said muzzle causing recoil and a portion of such gas is conducted through said passages to said two cylinders to force said two pistons and said movable housing attached thereto towards the rear, said movable housing sliding rearwardly along the barrel to counter the recoil, bumpers near the rear end of said barrel and the rearward end of said housing to stop rearward sliding of said housing along said barrel after discharge of said unfired cartridge and after said bullet leaves said muzzle of said barrel, a muzzle-brake threaded on the forward end of said housing to counter the recoil, a connecting ear attached to said housing between said forward and rearward ends, a tripod connected to said connecting ear, said tripod including a slider connected to said connecting ear and movable along an axis parallel to said barrel axis from forward position to a rearward position in response to recoil produced by discharge of said unfired cartridge, said tripod including second spring means biasing said slider toward its forward position, said tripod including screws to adjust the forward position of said slider, said tripod including a horizontal pin transverse to said barrel axis about which said slider pivots to allow aiming of the firearm in vertical plane, and said tripod including a vertical pin transverse to said barrel axis about which said slider pivots to allow aiming of the firearm in a horizontal plane.

* * * * *